US011554601B2

(12) United States Patent
Ochi et al.

(10) Patent No.: US 11,554,601 B2
(45) Date of Patent: Jan. 17, 2023

(54) ADDITIONAL MEMBER ATTACHING APPARATUS AND BINDING SYSTEM INCLUDING THE SAME

(71) Applicant: Horizon Inc., Takashima (JP)

(72) Inventors: Masaru Ochi, Takashima (JP); Shigenobu Fukuda, Takashima (JP); Tomonori Yachi, Takashima (JP)

(73) Assignee: Horizon Inc., Takashima (JP)

( * ) Notice: Subject to any disclaimer, the term of this patent is extended or adjusted under 35 U.S.C. 154(b) by 0 days.

(21) Appl. No.: 17/333,102

(22) Filed: May 28, 2021

(65) Prior Publication Data

US 2021/0379919 A1 Dec. 9, 2021

(30) Foreign Application Priority Data

Jun. 3, 2020 (JP) ..... JP2020-096844
Apr. 22, 2021 (JP) ..... JP2021-072667

(51) Int. Cl.
*B42C 9/02* (2006.01)
*B42C 19/08* (2006.01)
(Continued)

(52) U.S. Cl.
CPC ..... *B42C 9/02* (2013.01); *B42C 9/0056* (2013.01); *B42C 9/0062* (2013.01); *B42C 19/08* (2013.01); *B65H 35/008* (2013.01)

(58) Field of Classification Search
CPC ..... B42C 9/02; B42C 9/0056; B42C 9/0062
(Continued)

(56) References Cited

U.S. PATENT DOCUMENTS 2,646,104 A * 7/1953 Hawkes ..... B42C 19/02 412/27
3,166,463 A * 1/1965 Klostermann ..... B42C 9/02 156/355
(Continued)

FOREIGN PATENT DOCUMENTS

DE 4423093 A1 * 1/1996 ..... B42C 9/02
DE 10005493 A1 * 9/2001 ..... B42C 9/02
(Continued)

OTHER PUBLICATIONS

Extended European Search Report for European Application No. 21176221.6 dated Dec. 22, 2021.
(Continued)

*Primary Examiner* — Kyle R Grabowski
(74) *Attorney, Agent, or Firm* — Muncy, Geissler, Olds & Lowe, P.C.

(57) ABSTRACT

The embodiment includes: a roll accommodation unit that accommodates a roll of a continuous sheet of additional member; an unwinding unit that unwinds and draws the additional member from the roll accommodation unit to a trimming station; a trimming unit that is arranged in the trimming station and cuts and trims the additional member in accordance with the size of a book block to form a strip of additional member; a gripper that grips the strip of additional member while supporting the under face thereof, moves between a retracted position inside a housing and a forward position outside the housing, and moves between the forward position and a raised position above the forward position; and a handover unit that hands over the strip of additional member from the trimming station to the gripper located in the retracted position.

8 Claims, 7 Drawing Sheets

(51) Int. Cl.
*B65H 35/00* (2006.01)
*B42C 9/00* (2006.01)

(58) Field of Classification Search
USPC ..... 412/26, 27, 30, 34, 36
See application file for complete search history.

(56) References Cited

U.S. PATENT DOCUMENTS

| | | | | |
|---|---|---|---|---|
| 3,527,632 | A | 9/1970 | Holes et al. | |
| 3,888,722 | A * | 6/1975 | Blair | B42C 9/02 412/27 |
| 4,166,300 | A * | 9/1979 | Savich | B42C 9/02 412/27 |
| 4,177,410 | A | 12/1979 | Dowd | |
| 5,211,383 | A | 5/1993 | Valentinis | |
| 5,306,047 | A * | 4/1994 | Otake | B42D 3/002 412/37 |
| 5,894,978 | A | 4/1999 | Welch et al. | |
| 6,006,807 | A * | 12/1999 | Domes | B42C 9/0056 412/36 |
| 6,460,843 | B1 | 10/2002 | Dim et al. | |
| 7,527,255 | B2 | 5/2009 | Miyake et al. | |
| 8,858,148 | B2 | 10/2014 | De Marco et al. | |
| 8,882,099 | B2 | 11/2014 | Lewalski et al. | |
| 10,131,176 | B2 | 11/2018 | Thurnherr | |
| 2009/0078814 | A1 | 3/2009 | Prittle | |
| 2009/0279986 | A1 * | 11/2009 | Rogalski, Jr | B65H 35/0006 412/16 |
| 2010/0058907 | A1 | 3/2010 | Kern | |
| 2011/0262248 | A1 | 10/2011 | De Marco et al. | |
| 2013/0101331 | A1 | 4/2013 | Morrow et al. | |
| 2020/0387100 | A1 | 12/2020 | Takada et al. | |

FOREIGN PATENT DOCUMENTS

| | | | | |
|---|---|---|---|---|
| DE | 10 2016 218 042 | A1 | 3/2018 | |
| EP | 1902854 | A2 * | 3/2008 | B42C 1/00 |
| EP | 2 384 900 | A1 | 11/2011 | |
| EP | 2 517 892 | A1 | 10/2012 | |
| EP | 2 532 526 | A1 | 12/2012 | |
| FR | 1527187 | A * | 5/1968 | B42C 9/0056 |
| JP | 2014-198394 | A | 10/2014 | |
| NL | 7410262 | A * | 10/1974 | B42C 9/0062 |

OTHER PUBLICATIONS

Extended European Search Report for European Application No. 21175482.5 dated Oct. 25, 2021.

* cited by examiner

ADDITIONAL MEMBER ATTACHING APPARATUS AND BINDING SYSTEM INCLUDING THE SAME

CROSS-REFERENCE TO RELATED APPLICATIONS

This application is based on Japanese Patent Application No. 2020-96844, filed in Japan on Jun. 3, 2020 and Japanese Patent Application No. 2021-72667, filed in Japan on Apr. 22, 2021, the contents of which are incorporated herein by reference in its entirety.

BACKGROUND

1. Technical Field

The present disclosure relates to an additional member attaching apparatus provided separately from a binder and configured to supply an additional member from outside of the binder and attach the additional member to a glue-applied spine of the book block standing still and upright at an additional member attaching position inside the binder and relates to a binding system including the additional member attaching apparatus.

2. Description of Related Art

A perfect binder including a cheesecloth supply apparatus is known from a related art (for example, see Japanese Patent Application Laid-Open No. 2014-198394). Such a perfect binder includes a clamper that can clamp a book block standing upright and move along a predetermined path, a series of processing units (a milling unit, a pasting unit, and a case making unit) that are arranged along the path and perform a perfect binding process, and a book block supply unit that supplies a book block to the clamper at a book block supply position on the upstream of the series of processing units located on the path.

The case making unit has a pressing plate and a pair of nip plates provided on the upper face of the pressing plate. A case supply unit has a case placement shelf on which a case is placed and a case transport mechanism that transports the case from the case placement shelf onto the pressing plate and the pair of nip plates of the case making unit.

Once a binding process is started, a case is transported from the case placement shelf onto the pressing plate and the pair of nip plates of the case making unit by a case transport mechanism. Then, when a book block clamped by the clamper reaches and stops at a predetermined position above the pressing plate and the pair of nip plates, the pressing plate and the pair of nip plates are raised to a nip position, the case is pressed against the book block spine by the pressing plate, both sides of the book block spine are then clamped by the pair of nip plates, thereby the case is pressed against both sides of the book block spine, the case is attached to the book block, and a bound book is completed.

As discussed above, such a binder can implement binding of a paper back. On the other hand, when such a binder is used for a hard cover book (for forming a book block of a hard cover book), the case supply unit is not used, and the cheesecloth supply apparatus is used instead.

The cheesecloth supply apparatus includes a cheesecloth forming unit that forms a strip of cheesecloth in accordance with the shape of the book block and a transport unit that transports the strip of cheesecloth from the cheesecloth forming unit to the case making unit of the binder and supplies the strip of cheesecloth onto the pair of nip plates of the case making unit with the strip of cheesecloth being placed across these nip plates.

The cheesecloth forming unit includes a roll of a continuous sheet of cheesecloth, a drive unit that rotates the roll to feed the continuous sheet of cheesecloth out onto the placement stage, and first and second cutters that cut and trim, in the longitudinal direction and the width direction, the continuous sheet of cheesecloth fed out by the drive unit.

The first cutter is configured to be movable in the width direction of a continuous sheet of cheesecloth and cuts the cheesecloth in the longitudinal direction in accordance with the thickness of the book block. Further, in accordance with the head-to-foot length of the book block, the second cutter trims, in the width direction, the cheesecloth cut by the first cutter and positioned on the placement stage.

The transport unit has a suction tool that sucks a strip of cheesecloth placed on the placement stage and a rail extending from the placement stage to the case making unit. The rail extends from above of the placement stage to above of the book block clamped by the clamper stopped above the pressing plate and the pair of nip plates of the case making unit, and the suction tool is mounted to the rail movably along the rail.

In such a binder, when a book block of a hard cover book is formed, first, a strip of cheesecloth in accordance with the size of the book block is formed in the cheesecloth forming unit of the cheesecloth supply apparatus.

Subsequently, this strip of cheesecloth is supplied onto the pair of nip plates of the case making unit of the perfect binder by the transport unit of the cheesecloth supply apparatus with the strip of cheesecloth being placed across the nip plates.

In the book block supply position of the perfect binder, the book block is then supplied to the clamper, and the clamper clamping the book block reaches and stops at a predetermined position above the pressing plate and the pair of nip plates of the case making unit via the milling unit and the pasting unit.

Further, the pressing plate and the pair of nip plates are raised, the strip of cheesecloth is pressed against the book block spine by the pressing plate, both sides of the book block spine are then clamped by the pair of nip plates, thereby the strip of cheesecloth is pressed against both sides of the book block spine, and the strip of cheesecloth is attached to the book block spine.

As discussed above, according to the perfect binder including such a cheesecloth supply apparatus, since it is possible to form a strip of cheesecloth in accordance with the size of a book block and attach the strip of cheesecloth to the book block spine, this enables quick preparation even for a case of binding hard cover books from a plurality of book blocks having different sizes.

According to the above configuration, however, users who possess a perfect binder including no cheesecloth supply apparatus are required to purchase a new perfect binder for forming book blocks of hard cover books and have to pay significant cost for the purchase.

Further, the cheesecloth supply apparatus has a large scale structure, and this causes a problem of increased size of the perfect binder and need for a wider installation space.

BRIEF SUMMARY

Therefore, the object of the present disclosure is to provide an additional member attaching apparatus that supplies and attaches an additional member such as cheesecloth and can be easily installed to an existing paper back binder afterwards and provide a binding system including the additional member attaching apparatus. Further, another object of the present disclosure is to reduce the scale of the additional member attaching apparatus, which supplies and attaches an additional member such as cheesecloth, and the binding system including the same.

To achieve the above objects, according to one aspect of the present disclosure, provided is an additional member attaching apparatus connected to a binder and configured to supply an additional member from outside of the binder and attach the additional member to a glue-applied spine of a book block standing still and upright at an additional member attaching position inside the binder, the additional member attaching apparatus includes: a holding unit that holds the additional member while supporting an under face of the additional member; a first holding unit drive mechanism that causes the holding unit to move between a retracted position inside a housing and a forward position outside the housing; and a second holding unit drive mechanism that causes the holding unit to move between the forward position and a raised position above the forward position. The forward position is right under the spine of the book block stopped at the additional member attaching position inside the binder, and the raised position is a position where the additional member is pressed against the spine of the book block.

According to one preferred aspect of the present disclosure, provided is an additional member attaching apparatus including: a roll accommodation unit that accommodates a roll of a continuous sheet of additional member rotatably about an axis; an unwinding unit that unwinds and draws the continuous sheet of additional member from the roll accommodation unit to a trimming station; a trimming unit that is arranged in the trimming station and cuts and trims the continuous sheet of additional member unwound and drawn by the unwinding unit in accordance with a size of the book block to form a strip of additional member; and a handover unit that hands over the strip of additional member from the trimming station to the holding unit located in the retracted position.

According to one preferred aspect of the present disclosure, the additional member attaching apparatus includes a control unit that controls the first holding unit drive mechanism and the second holding unit drive mechanism, and the forward position and the raised position are input to the control unit.

According to one preferred aspect of the present disclosure, components of the holding unit and the first and second holding unit drive mechanisms and a component of the trimming unit are arranged vertically in two stages in arrangement such that the trimming unit is on the upper stage.

According to another preferred aspect of the present disclosure, the handover unit has a suction head that may suck the strip of additional member, and a suction head drive mechanism that causes the suction head to move between the trimming station and the retracted position of the holding unit.

According to yet another preferred aspect of the present disclosure, the first holding unit drive mechanism has at least one slide guide, a slider mounted to the slide guide, an arm extending parallel to the slide guide, mounted to the slider, and configured to be swingable about a horizontal axis transverse to a slide direction of the slider at a rear end of the arm, in which the holding unit is mounted to a leading end of the arm, and a slider drive mechanism that causes the slider to move between a recessed position where the holding unit is arranged in the retracted position and a projected position where the holding unit is arranged in the forward position. The second holding unit drive mechanism is formed of an arm drive mechanism that causes the arm to swing between a horizontal position and an inclined position inclined downward from the horizontal position, and when the slider is in the projected position and the arm enters the horizontal position, the holding unit enters the raised position.

According to yet another preferred aspect of the present disclosure, the suction head drive mechanism of the handover unit has a first suction head drive mechanism that causes the suction head to move horizontally and along the slide guide of the first holding unit drive mechanism, a second suction head drive mechanism that causes the suction head to move vertically, and a third suction head drive mechanism that causes the suction head to move horizontally, perpendicularly to the slide guide.

According to yet another preferred aspect of the present disclosure, the holding unit includes a gripper.

A binding system according one aspect of the present disclosure includes: the additional member attaching apparatus according to any of the aspects described above; and a binder to which the additional member attaching apparatus is connected.

The additional member attaching apparatus is connected to the binder in the arrangement such that the forward position of the holding unit is set right under the spine of a book block stopped at the additional member attaching position inside the binder and that the holding unit in the raised position presses an additional member against the book block spine. Further, the holding unit holds a strip of additional member handed over at the retracted position, moves from the retracted position to the forward position, then rises from the forward position to the raised position, releases the holding at the raised position, and then moves from the raised position down to the forward position, and thereby the strip of additional member is attached to the book block spine.

In such a way, the holding unit that holds a strip of additional member while supporting the under face thereof, moves between the retracted position inside the housing and the forward position outside the housing, and moves vertically between the forward position and the raised position above the forward position is provided, and the strip of additional member formed in accordance with the size of the book block is transferred from outside of the binder to the book block stopped at the additional member attaching position inside the binder by the holding unit and then attached to the book block spine.

Accordingly, the additional member attaching apparatus that supplies and attaches an additional member can be configured as a separate apparatus from a binder. Thus, by simply providing, to the binder, an opening used for accessing the additional member attaching position inside the binder from outside of the binder, it is possible to easily connect the additional member attaching apparatus of the present disclosure to any binder to supply a strip of additional member in accordance with the size of a book block from outside of the binder and attach the strip of additional member to the spine of the book block stopped at the additional member attaching position inside the binder.

Further, the user is able to form a book block of a hard cover book by installing afterwards the additional member attaching apparatus of the present disclosure to an existing paper back binder without newly purchasing a binder having a function of forming book blocks of hard cover books.

Furthermore, the trimming unit, the holding unit, and the first and second holding unit drive mechanisms (mechanisms that transfer an additional member to a book block spine inside the binder and attach the additional member thereto) are arranged in two stages vertically, which enables effective use of space. This can realize a reduction in size of the additional member attaching apparatus.

DETAILED DESCRIPTION

Figure 1:
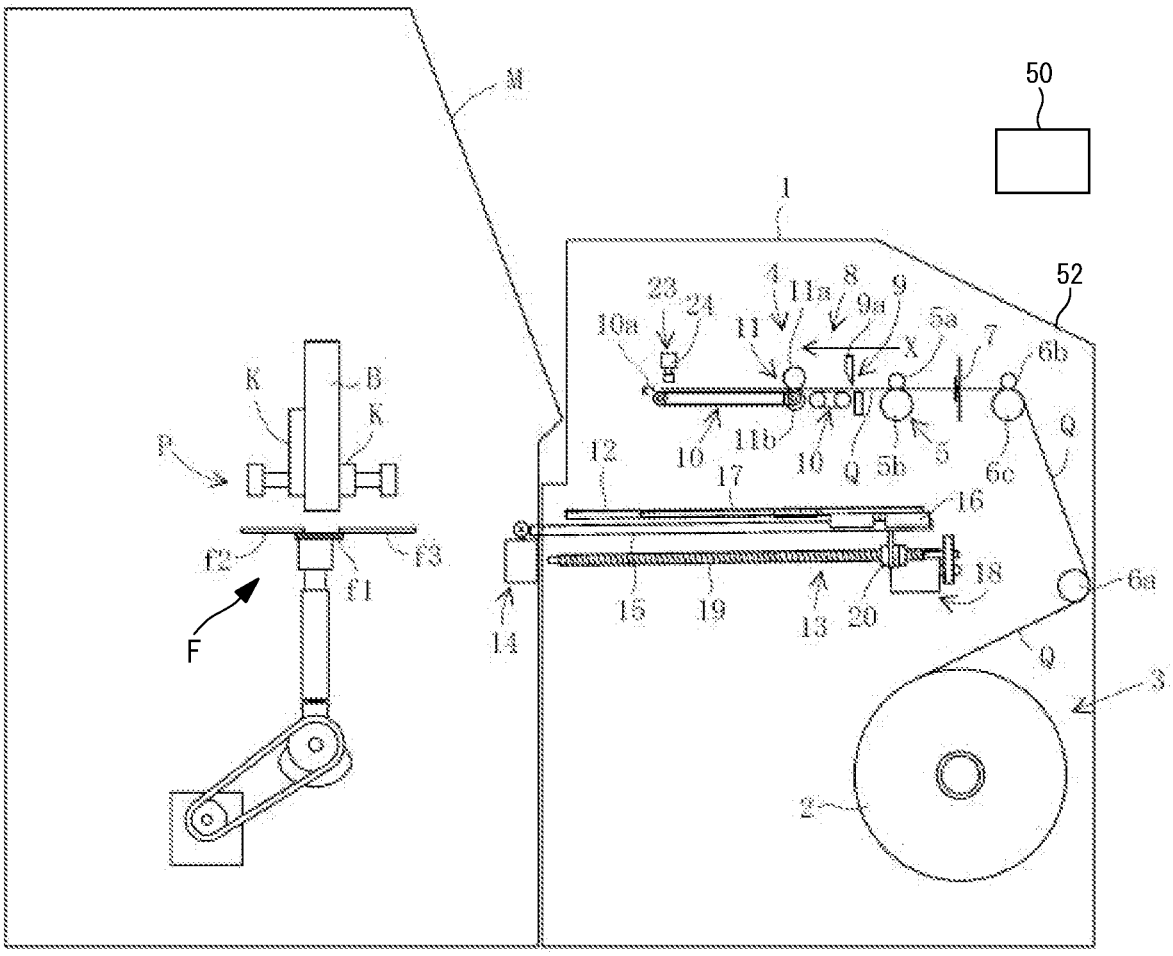
FIG. 1 illustrates a binding system according to a first embodiment of the present disclosure and is a side view schematically illustrating a configuration inside an additional member attaching apparatus.

The configuration of the present disclosure will be described below based on preferred embodiments with reference to the attached drawings. FIG. 1 is a side view schematically illustrating a configuration inside an additional member attaching apparatus that supplies and attaches an additional member to a book block spine according to first embodiment of the present disclosure.

FIG. 1 illustrates a binding system including a binder M and an additional member attaching apparatus 1, and the additional member attaching apparatus 1 is connected to the binder M. Further, in FIG. 1, for simplified illustration, only a suction head of a handover unit is depicted as a representative of the handover unit (details of the configuration thereof will be described later).

The additional member attaching apparatus 1 includes, inside a housing 52, a roll accommodation unit 3 that accommodates a roll 2 of a continuous sheet of additional member Q rotatably about the horizontal axis and an unwinding unit 5 that unwinds and draws a continuous sheet of additional member Q from the roll accommodation unit 3 to a trimming station 4. The operation of the unwinding unit 5 is controlled by a control unit 50.

As used herein, "additional member" refers to a sheet of member to be attached to a book block spine in a process for a hard cover book and may be, for example, cheesecloth, paper, or the like.

The unwinding unit 5 is formed of a pair of unwinding rollers 5*a* and 5*b* that may be driven and rotated about the horizontal axis, respectively.

Further, a guide roller 6*a* and a pair of guide rollers 6*b* and 6*c* are arranged between the roll accommodation unit 3 and the pair of unwinding rollers 5*a* and 5*b* and are rotatable about the horizontal axis, respectively. Note that the pair of guide rollers 6*b* and 6*c* may be configured to provide driving force such that reverse torque is applied in a direction opposite to the feed direction of the pair of unwinding rollers 5*a* and 5*b*. Thereby, tension can be applied to the additional member Q. When unwinding and drawing the additional member Q, the pair of the guide rollers 6*b* and 6*c* are rotated together in the transport direction by friction with the additional member Q while providing reverse torque thereto. However, when unwinding and drawing of the additional member Q is stopped, the reverse torque of the pair of guide rollers 6*b* and 6*c* is also stopped.

A continuous sheet of additional member Q unwound and drawn from the roll 2 is then introduced between the pair of unwinding rollers 5*a* and 5*b* via a part of the circumference surface of the guide roller 6*a* and a gap between the pair of guide rollers 6*b* and 6*c*. Then, every time the pair of unwinding rollers 5*a* and 5*b* are driven and rotated in response to an instruction from the control unit 50, a predetermined length of a continuous sheet of additional member Q is unwound and drawn from the roll 2 to the trimming station 4. The trimming station 4 is provided inside the housing 52.

Further, a curl remover 7 that restricts a curl of a continuous sheet of additional member Q is arranged between the pair of guide rollers 6*b* and 6*c* and the pair of unwinding rollers 5*a* and 5*b*.

The additional member attaching apparatus 1 further includes a trimming unit 8 that is arranged in the trimming station 4 and cuts and trims a continuous sheet of additional member Q unwound and drawn by the unwinding unit 5 in accordance with the size of a book block B to form a strip of additional member S.

The trimming unit 8 is arranged at the input port of the trimming station 4 and has a first cutter 9 that cuts, in a direction transverse to the unwinding direction (indicated by the arrow X), a continuous sheet of additional member Q unwound by a length in accordance with the thickness of the book block B by the unwinding unit 5, a transport mechanism 10 that transports the cut additional member from the first cutter 9 out in the unwinding direction (arrow X), and a second cutter 11 that is arranged in the transport path of the transport mechanism 10 and trims, in the unwinding direction (arrow X), the cut additional member transported on the transport path. The operation of the first cutter 9, the transport mechanism 10, and the second cutter 11 is controlled by the control unit 50.

The first cutter 9 has a straight blade 9*a* extending across the unwinding direction (arrow X), and the second cutter 11 has a pair of roll blades 11*a* and 11*b* that can be rotated about an axis transverse to the unwinding direction (arrow X).

Further, the position of the pair of roll blades 11*a* and 11*b* of the second cutter 11 can be adjusted in a direction transverse to the unwinding direction (arrow X) in accordance with the head-to-foot length of the book block B.

The trimming unit 8 further has a stopper 10*a* that extends across the transport path at the downstream end of the transport path of the transport mechanism 10 and stops a strip of additional member S when the leading end of the strip of additional member S transported out from the second cutter 11 comes into contact with the stopper 10*a*.

The additional member attaching apparatus 1 further includes a gripper (holding unit) 12 that can grip a strip of additional member S while supporting the under face of the strip of additional member S. The additional member attaching apparatus 1 includes a first gripper drive mechanism (first holding unit drive mechanism) 13 that causes the gripper 12 to move between a retracted position inside the housing 52 and a forward position outside the housing 52 and a second gripper drive mechanism (second holding unit drive mechanism) 14 that causes the gripper 12 to move between the forward position and a raised position above the forward position. The operation of the first gripper drive mechanism 13 and the second gripper drive mechanism 14 is controlled by the control unit 50.

Further, the components of the gripper 12 and the first and second gripper drive mechanisms 13 and 14 and the components of the trimming unit 8 are arranged vertically in two stages in the arrangement such that the trimming unit 8 is on the upper stage. The gripper 12 is located inside the housing 52 when the retracted position is applied and expands outside the housing 52 when the forward position is applied. The first gripper drive mechanism 13 has a main part arranged inside the housing 52, and the leading end side projects outside the housing 52 when the forward position is applied. The second gripper drive mechanism 14 is provided near outside of the housing 52. Therefore, as illustrated in FIG. 1, when the additional member attaching apparatus 1 is connected to the binder M, the second gripper drive mechanism 14 will be located inside the binder M. However, the second gripper drive mechanism 14 may be provided inside the housing 52.

Figure 2:
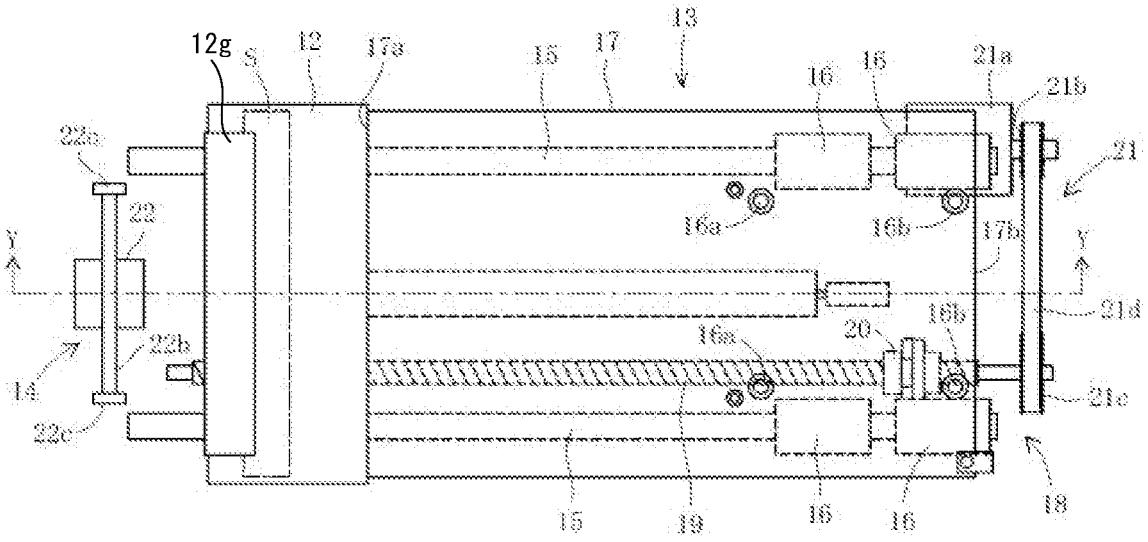
FIG. 2 is a plan view of a gripper and first and second gripper drive mechanisms of the additional member attaching apparatus of FIG. 1.

FIG. 2 is a plan view of the gripper 12 and the first and second gripper drive mechanisms 13 and 14 of the additional member attaching apparatus 1 of FIG. 1. Further, FIGS. 3A and 3B and FIGS. 4A and 4B each are a sectional view taken along the line Y-Y of FIG. 2, which illustrate the operation of the gripper 12 and the first and second gripper drive mechanisms 13 and 14 of FIG. 2.

The gripper 12 includes a gripping portion 12*g* that grips a strip of additional member S. The gripping portion 12*g* is able to come close to and move away from the placement face of the gripper 12 on which a strip of additional member S is placed and temporarily fixes the additional member S by pressing the additional member S against the placement face. The operation of the gripping portion 12*g* is controlled by the control unit 50.

Figure 3A:
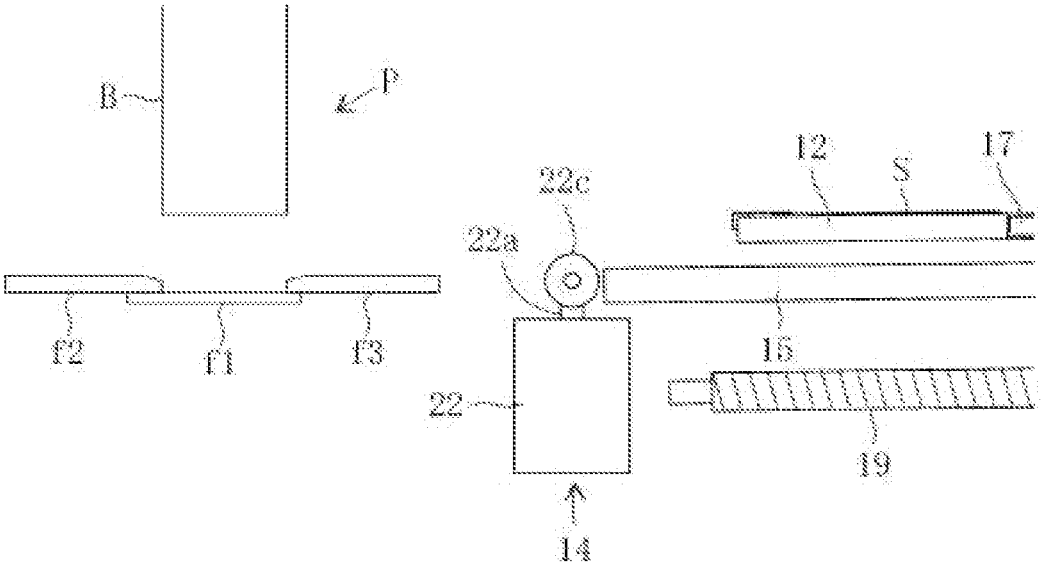
FIG. 3A illustrates the gripper and the first and second gripper drive mechanisms of FIG. 2 and is a sectional view taken along a line Y-Y of FIG. 2 when the gripper is in a retracted position.
Figure 3B:
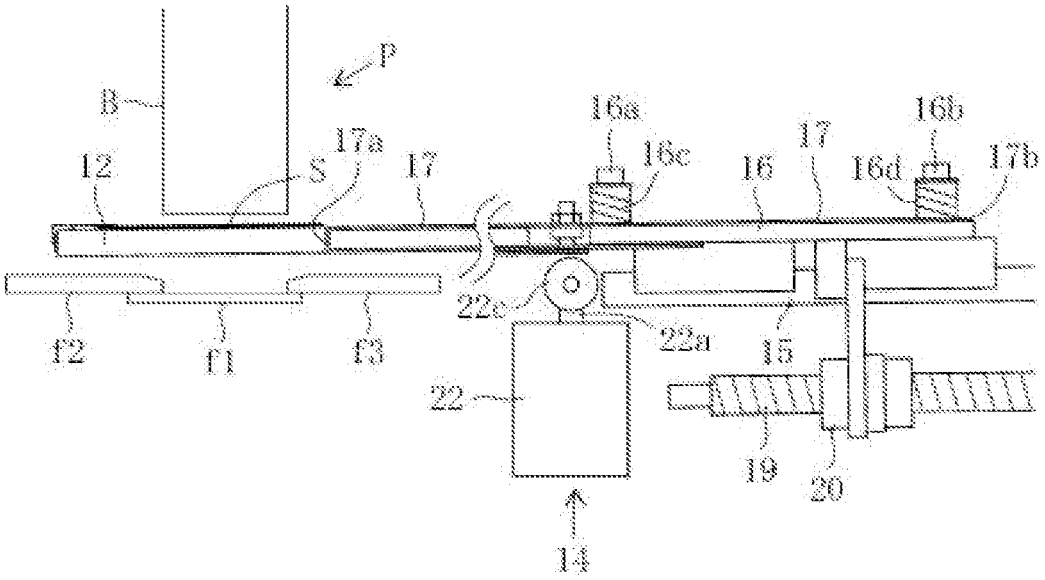
FIG. 3B is a sectional view when the gripper is in a forward position in comparison with FIG. 3A.

Referring to FIG. 2 to FIG. 4B, the first gripper drive mechanism 13 has at least one (two in this example) slide guide(s) 15 extending from inside to outside of the housing 52 and inclined downward, sliders 16 mounted to respective slide guides 15, a planar arm 17 extending in parallel to the slide guides 15, mounted to the upper face of the sliders 16, configured to be swingable about a rear end edge 17*b* as a spindle, and having a leading end 17*a* to which the gripper 12 is mounted, and a slider drive mechanism 18 configured to cause the sliders 16 to move between a recessed position where the gripper 12 is arranged in the retracted position (see FIG. 1, FIG. 3A) and a projected position where the gripper 12 is arranged in a forward position (see FIG. 3B).

The arm 17 is mounted to each slider 16 by using a pair of flanged pins 16*a* and 16*b* inserted through a pair of through holes, respectively, which are provided on both sides of the arm 17 with a spacing in the front-rear direction, and fixed to the slider 16, a compression spring 16*c* arranged between the arm 17 and a flange of the front side flanged pin 16*a* out of the pair of flanged pins 16*a* and 16*b*, and a compression spring 16*d* arranged between the arm 17 and a flange of the rear side flanged pin 16*b* out of the pair of flanged pins 16*a* and 16*b*. The front side compression spring 16*c* has a smaller elastic modulus than the rear side compression spring 16*d*.

The slider drive mechanism 18 has a ball screw 19 extending in parallel to the slide guide 15 and arranged rotatably about an axis at a fixed position, a ball screw nut 20 provided to the slider 16 and engaged with the ball screw 19, and a ball screw drive mechanism 21 configured to rotate the ball screw 19 about the axis.

The ball screw drive mechanism 21 is formed of a motor 21*a* arranged on the rear end side of the ball screw 19 such that the drive shaft is parallel to the ball screw 19, a pulley 21*b* fixed to the drive shaft of the motor 21*a*, a pulley 21*c* fixed to the rear end of the ball screw 19, and an endless belt 21*d* hung between the pulley 21*b* and the pulley 21*c*.

Further, when the ball screw 19 is rotated in the forward or reverse direction by the ball screw drive mechanism (motor 21*a*), the slider 16 slides along the slide guide 15.

The second gripper drive mechanism 14 is formed of an arm drive mechanism that causes the arm 17 to swing about the rear end edge 17*b* (spindle) of the arm 17 between the horizontal position (see FIG. 4A) and an inclined position (see FIG. 3B) inclined downward from the horizontal position (extending in parallel to the slide guide 15).

The arm drive mechanism is formed of an air cylinder 22 arranged in front of the projected position of the slider 16 and under the arm 17 and extending vertically, a horizontal support shaft 22*b* is mounted to the tip of a piston rod 22*a* of the air cylinder 22 and extends in a direction transverse to the transport path, and a roller 22*c* is mounted at both ends of the support shaft 22*b* rotatably about the support shaft 22*b*.

Further, the piston rod 22*a* of the air cylinder 22 reciprocates between the first position where the roller 22*c* is recessed below the inclined position of the arm 17 and the second position where the roller 22*c* projects above from the inclined position of the arm 17.

In such a way, while the piston rod 22*a* of the air cylinder 22 is normally at the first position, the piston rod 22*a* moves from the first position to the second position when the slider 16 enters the projected position, and thereby the arm 17 swings from the inclined position to the horizontal position. Subsequently, the piston rod 22*a* returns from the second position to the first position, and thereby the arm 17 swings from the horizontal position to the inclined position.

The additional member attaching apparatus 1 further has a handover unit 23 that hands over a strip of additional member S from the trimming station 4 to the gripper 12 located in the retracted position. The operation of the handover unit 23 is controlled by the control unit 50.

Figure 5:
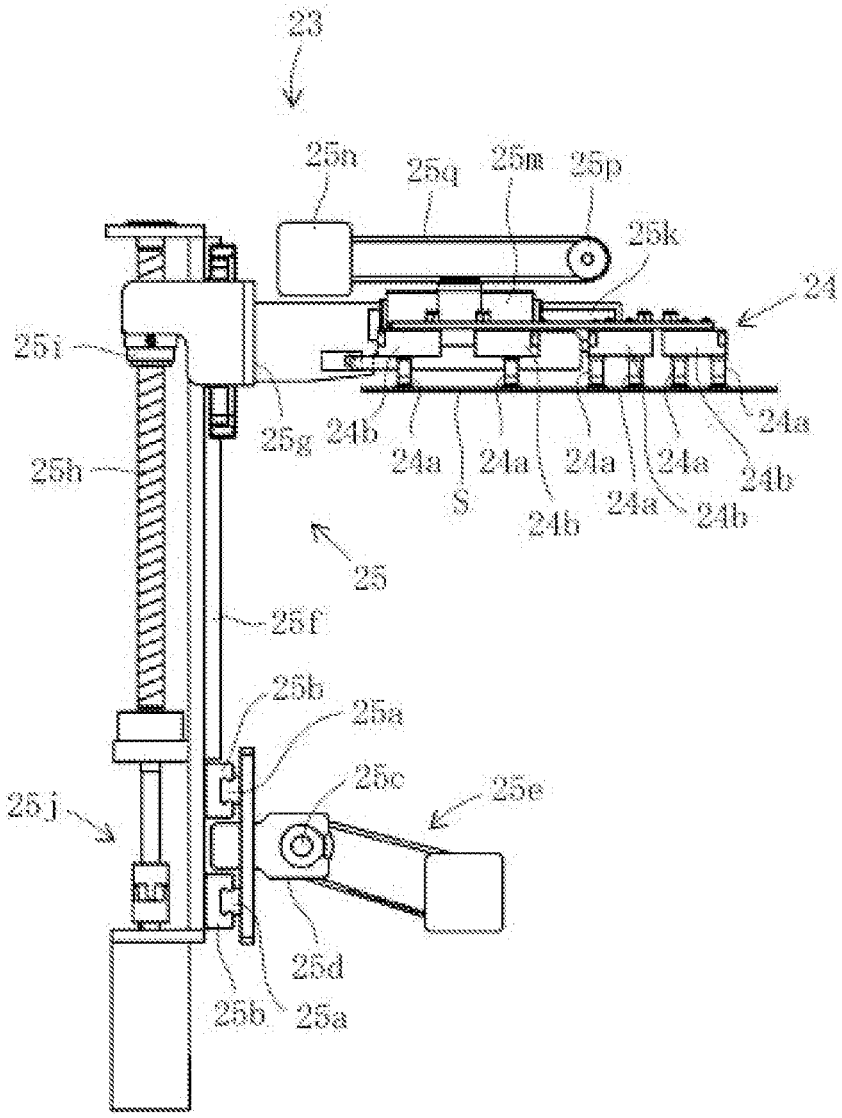
FIG. 5 is a front view of a handover unit of the additional member attaching apparatus of FIG. 1.

FIG. 5 is a front view of the handover unit (a view when viewed in the arrow X direction of FIG. 1).

As illustrated in FIG. 5, the handover unit 23 has a suction head 24 that can suck a strip of additional member S and a suction head drive mechanism 25 that causes the suction head 24 to move between the retracted positions of the trimming station 4 and the gripper 12.

The suction head 24 has a plurality of suction cups 24*a* and a negative pressure generation unit 24*b* that causes each suction cup 24*a* to generate suction force.

The suction head drive mechanism 25 has a first slide guide 25*a* extending in the horizontal direction and along the slide guide 15 of the first gripper drive mechanism 13, a first slider 25*b* mounted to the first slide guide 25*a*, a first ball screw 25*c* extending in parallel to the first slide guide 25*a* and arranged rotatably about an axis at a fixed position, a first ball screw nut 25*d* mounted to the first slider 25*b* and engaged in the first ball screw 25*c*, and a first rotation drive mechanism 25*e* configured to rotate the first ball screw 25*c*.

The suction head drive mechanism 25 further has a second slide guide 25*f* mounted to the first slider 25*b* and extending vertically, a second slider 25*g* mounted to the second slide guide 25*f*, a second ball screw 25*h* mounted to the first slider 25*b*, extending in parallel to the second slide guide 25*f*, and configured to be rotatable about an axis at the fixed position, a second ball screw nut 25*i* mounted to the second slider 25*g* and engaged with the second ball screw 25*h*, and a second rotation drive mechanism 25*j* mounted to the first slider 25*b* and configured to rotate the second ball screw 25*h*.

The suction head drive mechanism 25 further has a third slide guide 25*k* mounted to the second slider 25*g* and extending horizontally, perpendicularly to the first slide guide 25*a*, a third slider 25*m* mounted to the third slide guide 25*k*, a motor 25*n* mounted to the second slider 25*g* and having a drive shaft (not illustrated) extending in parallel to the first slide guide 25*a*, a pulley 25*p* mounted to the second slider 25*g* and configured to be rotatable about an axis parallel to the drive shaft of the motor 25*n*, and an endless belt 25*q* hung between a pulley (not illustrated) mounted to the drive shaft of the motor 25*n* and the pulley 25*p* and having the third slider 25*m* fixed thereto.

Further, the suction head 24 is mounted to the third slider 25*m* in arrangement such that the plurality of suction cups 24*a* face downward and are aligned on a straight line along the third slide guide 25*k*.

In such a way, when the first ball screw 25*c* is rotated in the forward or reverse direction by the first rotation drive mechanism 25*e*, the suction head 24 moves in a direction to come close to or move away from the gripper 12 in the trimming station 4 or in the retracted position. Further, when the second ball screw 25*h* is rotated in the forward or reverse direction by the second rotation drive mechanism 25*j*, the suction head 24 moves up and down. Further, when the endless belt 25*q* is rotated in the forward or reverse direction by the motor 25*n*, the suction head 24 moves in the longitudinal direction of a strip of additional member S.

The control unit 50 is formed of a central processing unit (CPU), a random access memory (RAM), a read only memory (ROM), a computer readable storage medium, and the like, for example. Further, a series of processes to implement various functions are stored in the storage medium or the like in a form of a program as an example, and various functions are implemented when the CPU reads such a program to the RAM or the like and performs processing of information or operational processing. Note that a form in which a program is installed in advance in a ROM or another storage medium, a form in which a program is provided in a state of being stored in a computer readable storage medium, a form in which a program is delivered via a wired or wireless communication scheme, or the like may be applied to the program. The computer readable storage medium may be a magnetic disk, a magneto-optical disk, a CD-ROM, a DVD-ROM, a semiconductor memory, or the like.

Next, the operation of the additional member attaching apparatus 1 will be described.

Referring again to FIG. 1, the additional member attaching apparatus 1 is connected to the binder M in the arrangement such that the forward position of the gripper 12 is right under the spine of the book block B stopped at the additional member attaching position P inside the binder M and that the gripper 12 in the raised position presses a strip of additional member S against the spine of the book block B.

At this time, adjustment is made so that a reference position set in advance on the additional member attaching apparatus 1 side (for example, the position of the end of the additional member R on the opposite side to the end trimmed by the second cutter 11) and a reference position set in advance on the binder M side (for example, the position of the end on the forward direction end side of the book block B clamped by a clamper K stopped at the additional member attaching position P) are matched.

Further, the position of the stopper 10*a* of the trimming unit 8 is adjusted and set so that a strip of additional member S stopped by the stopper 10*a* is arranged substantially in parallel to the spine of the book block B stopped at the additional member attaching position P of the binder M.

Note that, in this embodiment, the binder M is a perfect binder, the additional member attaching position P is a case making position of the perfect binder (the position right above a pressing plate f1 and a pair of nip plates f2 and f3 of a case making unit F), and the clamper K clamping the book block B standing upright is stopped at the case making position.

Prior to the operation of the additional member attaching apparatus 1, the head-to-foot length and the thickness of the book block B are input to the control unit 50 of the additional member attaching apparatus 1 through a control panel (not illustrated), initial setting of the additional member attaching apparatus 1 is performed based on the input values, and the operation of the additional member attaching apparatus 1 is then started.

Then, every time a continuous sheet of additional member Q is drawn to the trimming station 4 by a length corresponding to the thickness of the book block B by the unwinding unit 5, the first cutter 9 operates, and the continuous sheet of additional member Q is cut in its width direction.

The additional member cut by the first cutter 9 is trimmed into a length corresponding to the head-to-foot length of the book block B by the second cutter 11 while being transported by the transport mechanism 10, and a strip of additional member S is formed. The strip of additional member S is further transported downstream of the second cutter 11 and then comes into contact with the stopper 10*a* and stops on the transport path.

The strip of additional member S is then transported from the trimming station 4 (the downstream end of the transport path of the transport mechanism 10) to the gripper 12 in the retracted position by the suction head 24 (the handover unit 23) and handed over to the gripper 12 (see FIG. 3A).

During this transportation, the suction head 24 moves in the head-to-foot direction of the book block B in order to align the strip of additional member S with respect to the longitudinal direction of the spine of the book block B based on the head-to-foot length of the book block B and the length of the strip of additional member S input in advance to the control unit 50 of the additional member attaching apparatus 1.

In such a way, the strip of additional member S is handed over to the gripper 12 by the suction head 24 while aligned with respect to the longitudinal direction of the spine of the book block B.

Next, the slider 16 slides toward the binder M while the arm 17 is maintained in the inclined position, and the gripper 12 enters the forward position while gripping the strip of additional member S (see FIG. 3B).

At this time, the distance that the gripper 12 moves forward from the retracted position is adjusted in order to align the strip of additional member S with respect to the thickness direction of the spine of the book block B based on the thickness of the book block B and the thickness of the strip of the additional member S input in advance to the control unit 50 of the additional member attaching apparatus 1.

Accordingly, when the gripper 12 is in the forward position, the strip of additional member S (the gripper 12) is located right under a glue-applied spine of the book block B stopped at the additional member attaching position P.

Figure 4A:
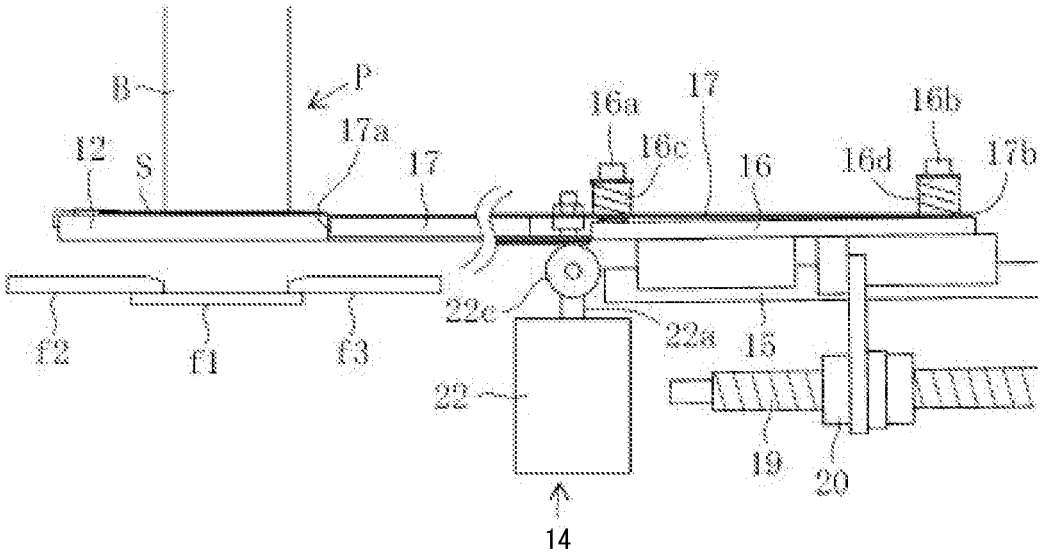
FIG. 4A illustrates the gripper and the first and second gripper drive mechanisms of FIG. 2 and is a sectional view taken along a line Y-Y of FIG. 2 when the gripper is in a raised position.
Figure 4B:
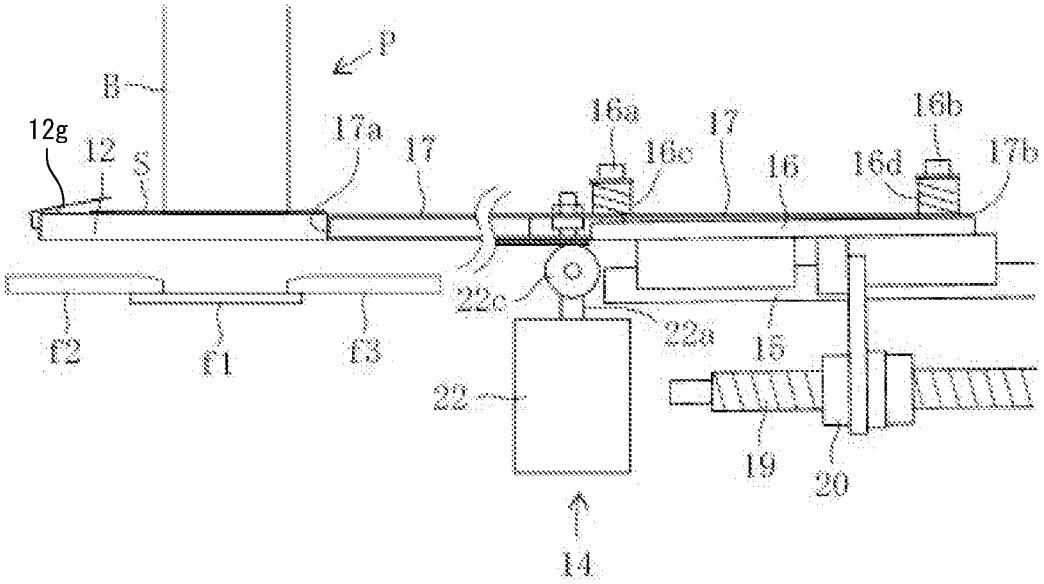
FIG. 4B illustrates a sectional view when the gripper has released a gripping portion in the raised position in comparison with FIG. 4A.

Subsequently, the arm 17 swings from the inclined position to the horizontal position, and thus the gripper 12 moves from the forward position to the raised position (see FIG. 4A). Thereby, the strip of additional member S is attached to the spine of the book block B. Then, after the gripper 12 operates the gripping portion 12*g* to release the gripping of the strip of additional member S (see FIG. 4B), the arm 17 swings from the horizontal position to the inclined position, and attachment of the additional member is completed. The slider 16 then moves toward the additional member attaching apparatus 1 side, the gripper 12 enters the retracted position, and the next strip of additional member S is handed over to the gripper 12 by the suction head 24 (see FIG. 3A). After the gripper 12 enters the retracted position, the additional member S is pressed by the pressing plate f1 and the pair of nip plates f2 and f3 of the case making unit F of the binder M to perform back lining of the book block B.

As described above, according to the present embodiment, the gripper 12 that grips a strip of additional member S while supporting the under face thereof, moves between the retracted position inside the housing 52 and the forward position outside the housing 52, and moves between the forward position and the raised position above the forward position is provided, and a strip of additional member S formed in accordance with the size of the book block B is transferred by the gripper 12 from outside of the binder M to the book block B stopped at the additional member attaching position P inside the binder M and then attached to the spine of the book block B.

Accordingly, the additional member attaching apparatus 1 can be a separate apparatus from the binder M. By simply providing, to the binder M, an opening used for accessing the additional member attaching position P inside the binder from outside of the binder, it is possible to easily connect the additional member attaching apparatus 1 to the binder M, supply a strip of additional member S in accordance with the size of the book block B from outside of the binder, and attach the strip of additional member S to the spine of the book block B stopped at the additional member attaching position P inside the binder.

Further, the user can form a book block of a hard cover book by installing afterwards the additional member attaching apparatus 1 to the existing paper back binder M without newly purchasing a binder M having a function of forming book blocks of hard cover books.

Furthermore, according to the present embodiment, the components of the trimming unit 8 and the components of the gripper 12 and the first and second gripper drive mechanisms 13 and 14 (mechanisms that transfer an additional member to a book block spine inside the binder and attach the additional member thereto) are arranged in two stages vertically, which enables effective use of space. This can realize a reduction in size of the additional member attaching apparatus 1.

As described above, although the configuration of the present disclosure has been described based on the preferred embodiment, the configuration of the present disclosure is not limited to the embodiment described above, and it is obvious that those skilled in the art may propose various modified examples within the scope of the configuration described in the appended claims.

For example, although the gripper 12 that grips a strip of additional member S is provided in the embodiment described above, any known unit (such as a unit having a suction function) that may hold a strip of additional member S while supporting the under face of the strip of additional member S may be used instead of the gripper 12.

What is claimed is:

1. An additional member attaching apparatus configured to be connected to a binder and configured to supply an additional member from outside of the binder and attach the additional member to a glue-applied spine of a book block standing still and upright at an additional member attaching position inside the binder, the additional member attaching apparatus comprising:

a holding unit that holds the additional member while supporting an under face of the additional member;

a first holding unit drive mechanism that causes the holding unit to move between a retracted position inside a housing and a forward position outside the housing; and a second holding unit drive mechanism that causes the holding unit to move between the forward position and a raised position above the forward position;

a roll accommodation unit that accommodates a roll of a continuous sheet of the additional member rotatably about an axis;

an unwinding unit that unwinds and draws the continuous sheet of additional member from the roll accommodation unit to a trimming station;

a trimming unit that is arranged in the trimming station and cuts and trims the continuous sheet of additional member unwound and drawn by the unwinding unit in accordance with a size of the book block to form a strip of additional member; and a handover unit that hands over the strip of additional member from the trimming station to the holding unit located in the retracted position, wherein the forward position is right under the spine of the book block stopped at the additional member attaching position inside the binder, wherein the raised position is a position where the additional member is pressed against the spine of the book block, and wherein components of the holding unit and the first and second holding unit drive mechanisms and a component of the trimming unit are arranged vertically in two stages in arrangement such that the trimming unit is on the upper stage.

2. The additional member attaching apparatus according to claim 1, further comprising a control unit that controls the first holding unit drive mechanism and the second holding unit drive mechanism, wherein the forward position and the raised position are input to the control unit.

3. The additional member attaching apparatus according to claim 1, wherein the handover unit has a suction head that sucks the strip of additional member, and a suction head drive mechanism that causes the suction head to move between the trimming station and the retracted position of the holding unit.

4. The additional member attaching apparatus according to claim 1, wherein the first holding unit drive mechanism has at least one slide guide, a slider mounted to the slide guide, an arm extending parallel to the slide guide, mounted to the slider, and configured to be swingable about a horizontal axis transverse to a slide direction of the slider at a rear end of the arm, wherein the holding unit is mounted to a leading end of the arm, and a slider drive mechanism that causes the slider to move between a recessed position where the holding unit is arranged in the retracted position and a projected position where the holding unit is arranged in the forward position, wherein the second holding unit drive mechanism is formed of an arm drive mechanism that causes the arm to swing between a horizontal position and an inclined position inclined downward from the horizontal position, and wherein when the slider is in the projected position and the arm enters the horizontal position, the holding unit enters the raised position.

5. The additional member attaching apparatus according to claim 4, wherein the suction head drive mechanism of the handover unit has a first suction head drive mechanism that causes the suction head to move horizontally and along the slide guide of the first holding unit drive mechanism, a second suction head drive mechanism that causes the suction head to move vertically, and a third suction head drive mechanism that causes the suction head to move horizontally, perpendicularly to the slide guide.

6. The additional member attaching apparatus according to claim 1, wherein the additional member is attached to the glue-applied spine of the book block when the second holding unit drive mechanism causes the holding unit to move from the forward position to the raised position.

7. The additional member attaching apparatus according to claim 1, wherein the holding unit comprises a gripper.

8. A binding system comprising:

the additional member attaching apparatus according to claim 1; and a binder to which the additional member attaching apparatus is connected.

* * * * *